US009275564B2

(12) United States Patent
Lime

(10) Patent No.: US 9,275,564 B2
(45) Date of Patent: Mar. 1, 2016

(54) PANORAMIC DIVER DOWN FLAG

(71) Applicant: Vance K. Lime, Honolulu, HI (US)

(72) Inventor: Vance K. Lime, Honolulu, HI (US)

( * ) Notice: Subject to any disclaimer, the term of this patent is extended or adjusted under 35 U.S.C. 154(b) by 243 days.

(21) Appl. No.: 13/898,975

(22) Filed: May 21, 2013

(65) Prior Publication Data

US 2014/0345515 A1 Nov. 27, 2014

(51) Int. Cl.
*G09F 17/00* (2006.01)
*B63C 11/26* (2006.01)

(52) U.S. Cl.
CPC ..... *G09F 17/00* (2013.01); *B63C 11/26* (2013.01); *G09F 2017/0083* (2013.01)

(58) Field of Classification Search
CPC ..... B63C 11/26; G09F 2017/0083
USPC ..... 116/209; 40/603, 604, 606.17; 441/6; D11/165, 181
See application file for complete search history.

(56) References Cited

U.S. PATENT DOCUMENTS 1,476,426 A * 12/1923 Short ..... 116/174
5,609,122 A * 3/1997 Jimmie ..... 116/173
5,735,719 A * 4/1998 Berg ..... 441/11

* cited by examiner

*Primary Examiner* — Daniel S Larkin
*Assistant Examiner* — Irving A Campbell
(74) *Attorney, Agent, or Firm* — Alleman Hall McCoy Russell & Tuttle LLP

(57) ABSTRACT

A three-dimensional, panoramic diver down flag visible having increased visibility is disclosed herein. In one embodiment, a diver down flag includes a first indicator and a second indicator positioned obliquely to the first indicator. A separation member is disposed between the first and the second indicator, the separation member configured to maintain an angular separation between the first and the second indicator.

9 Claims, 5 Drawing Sheets

PANORAMIC DIVER DOWN FLAG

BACKGROUND AND SUMMARY

Oceans, and other bodies of water, serve as major attractions for individuals by providing mediums in which a wide variety of sports and activities may be performed, such as snorkeling, scuba diving, and free diving. During such activities, individuals may descend beneath the surface of a body of water, becoming increasingly difficult to see as their depths increase. Caution thus must be taken to protect the individuals and increase their visibility. As such, indicators such as diver down flags may be used and even required by law to indicate the presence of a diver to other water-goers and vessels, and to signal to such vessels to reduce speed and maintain a predetermined separation distance.

The inventor herein has recognized that although such diver down flags increase the visibility of individuals and signal their presence to others, the flags may not be visible in certain situations. Due to their flat, two-dimensional shape, diver down flags may be substantially invisible when viewed along their edge as opposed to face. Vessels approaching from certain perspectives, for example, may be unable to locate the diver down flag and may thus be unaware of a diver's presence.

A three-dimensional, panoramic diver down flag visible having increased visibility is disclosed herein. In one embodiment, a diver down flag includes a first indicator and a second indicator positioned obliquely to the first indicator. A separation member is disposed between the first and the second indicator, the separation member configured to maintain an angular separation between the first and the second indicator.

In this way, a three-dimensional, panoramic diver down flag may be provided which may be visible and observed from each sightline in a 360° range along a surface of a body of water.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

A variety of activities may be performed in which individuals break and descend below the surface of a body of water, such as snorkeling, scuba diving, and free diving. Such individuals (e.g., divers) may utilize, voluntarily or as stipulated by law, a diver down flag to signify their presence. In addition to indicating the presence of a diver, a diver down flag may also warn approaching vessels to maintain a predetermined separation distance (e.g., 100 feet) and to reduce their speed when in proximity (e.g., a speed below that which may produce wakes or other currents). Typical diver down flags may be attached to a diver's vessel or to a surface marker buoy, for example, and may be substantially two-dimensional with substantial height and width but low thickness. Thus, such diver down flags may be difficult to see or may even be invisible from certain perspectives—e.g., as a vessel approaches a flag from an edge-on perspective as opposed to a face-on perspective.

Figure 1A:
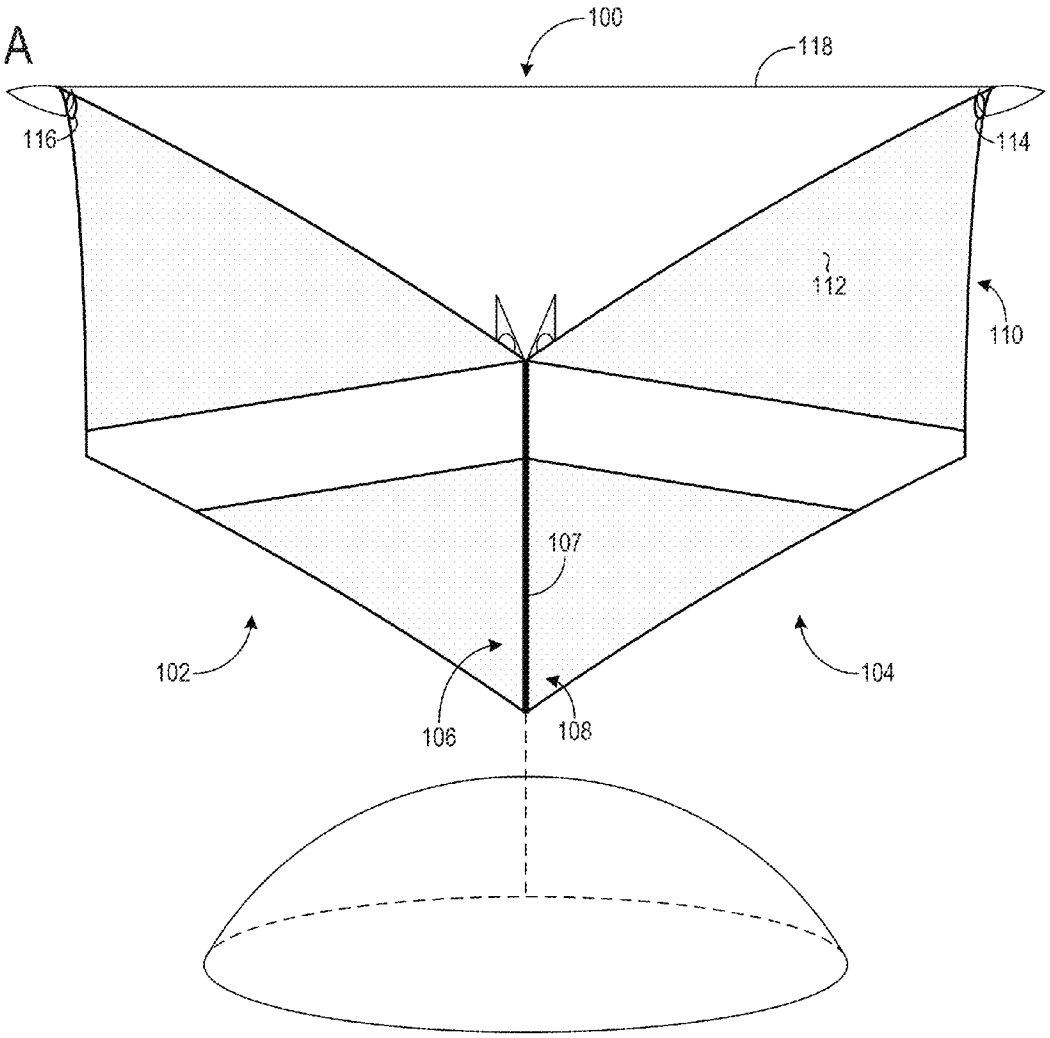
FIG. 1A illustrates an anterior view of an example embodiment of a panoramic diver down flag in accordance with the present disclosure.
Figure 1B:
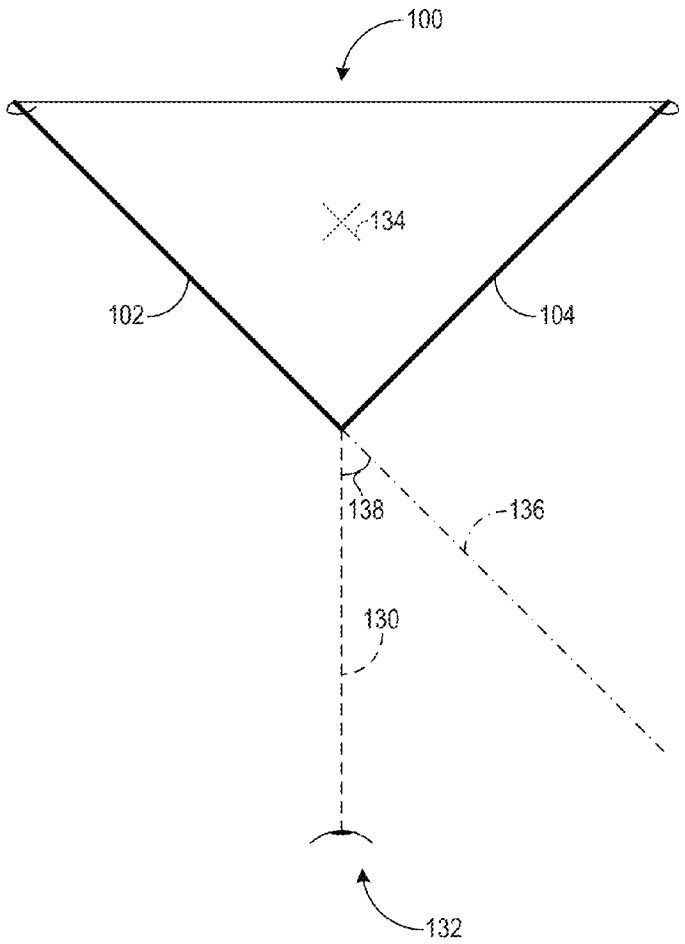
FIG. 1B illustrates a top view of the panoramic diver down flag of FIG. 1A.
Figure 2:
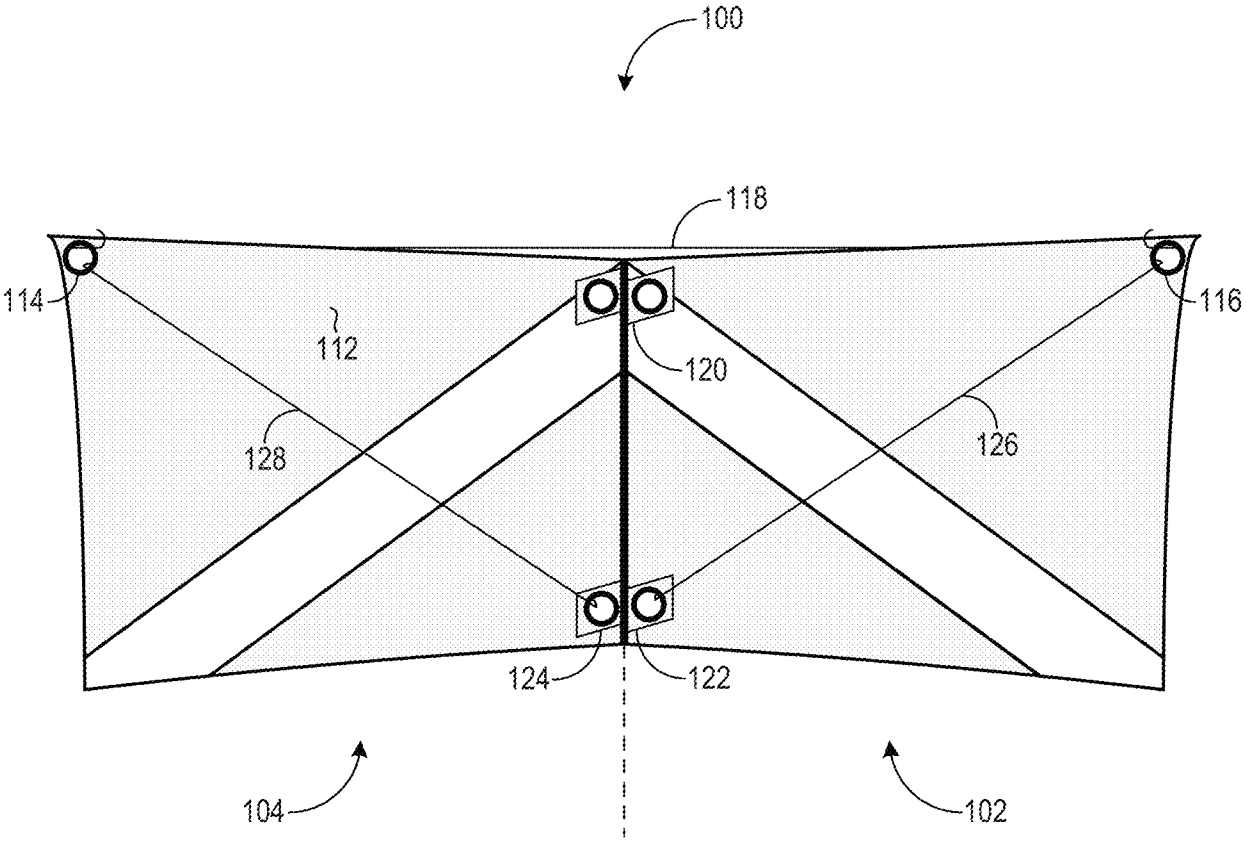
FIG. 2 illustrates a posterior view of the panoramic diver down flag of FIGS. 1A and 1B.
Figure 3:
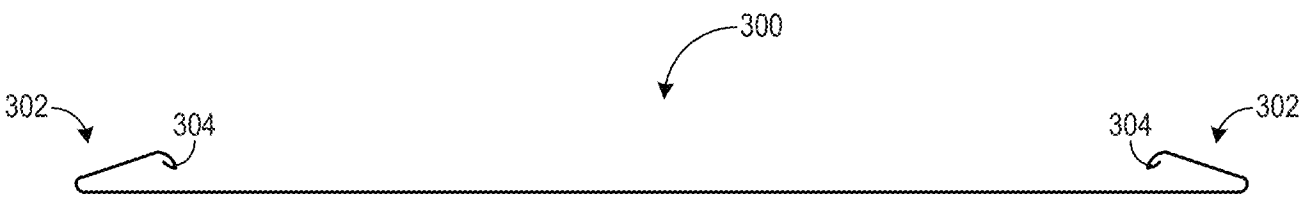
FIG. 3 illustrates an example embodiment of a separation member in accordance with the present disclosure.
Figure 4A:
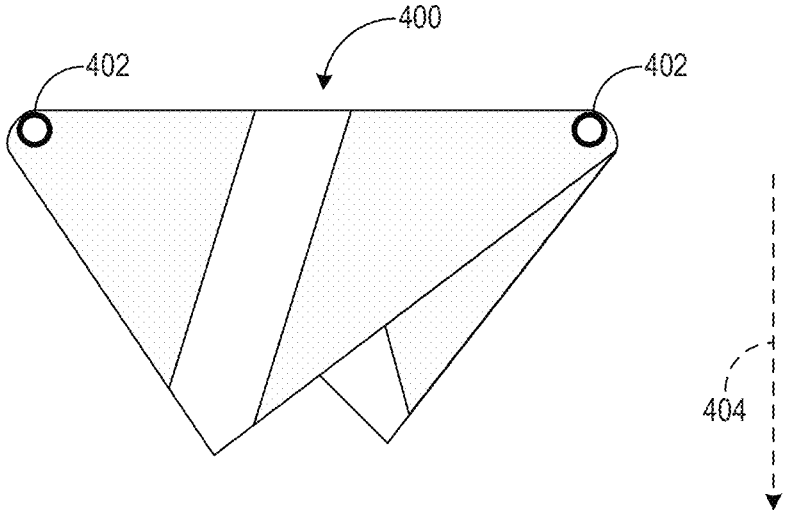
FIGS. 4A and 4B illustrate exemplary scenarios in which a panoramic diver down flag may be rolled and packed.
Figure 4B:
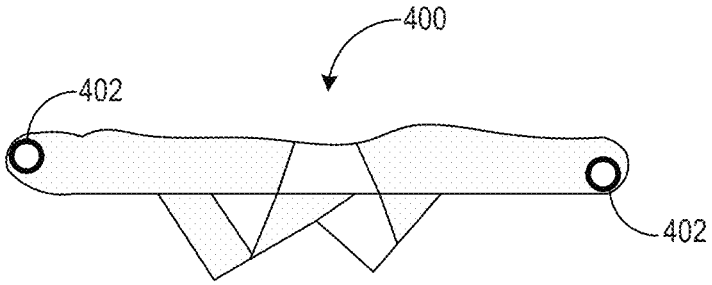

Accordingly, embodiments are disclosed herein that relate to panoramic, three-dimensional diver down flags which may be observed from any perspective about a vertical axis of a body of water on which the diver down flag is floating. In one embodiment, diver down flag includes a first indicator and a second indicator positioned obliquely to the first indicator. A separation member is disposed between the first and the second indicator, the separation member configured to maintain an angular separation between the first and the second indicator. FIG. 1A illustrates an anterior view of an example embodiment of a panoramic diver down flag in accordance with the present disclosure, FIG. 1B illustrates a top view of the panoramic diver down flag of FIG. 1A., FIG. 2 illustrates a posterior view of the panoramic diver down flag of FIGS. 1A and 1B, FIG. 3 illustrates an example embodiment of a separation member in accordance with the present disclosure, and FIGS. 4A and 4B illustrate exemplary scenarios in which a panoramic diver down flag may be rolled and packed.

FIG. 1A shows an anterior view of an embodiment of a panoramic diver down indicator or flag 100 in accordance with the present disclosure. Indicator or flag 100 includes a first indicator or flag 102 and a second indicator or flag 104. First and second flags 102 and 104 are attached to each other in this example along a seam 106 by attaching inner edges (e.g., an inner edge 108 of second flag 104) of the first and second flags to each other, the flags forming a mirror image of each other about seam 106. A suitable technique may be used to attach the inner edges of first and second flags 102 and 104 to each other, including sewing, gluing, etc. In other embodiments, first and second flags 102 and 104 may be integrally formed with a crease, fold, or other flexure applied during the formation process such that the middle of the integrally formed flag creates an angled, V-like junction as shown in the illustrated example.

As shown, an angle may be formed between first and second flags 102 and 104 to create such a junction. The angle may be, for example, an oblique angle (e.g., 45°) such that second flag 104 is positioned obliquely to first flag 102. Other angles are possible, however, including smaller angles (e.g., 30°) and larger angles (e.g., 60°). The angle may be adjusted based on the physical characteristics of spreading members, as described in further detail below.

In some embodiments, seam 106 may be substantially formed at an extreme perimeter of the inner edges of each flag—e.g., a negligible portion of the inner edges bounds the seam. In other embodiments, seam 106 may be disposed at a predetermined distance away from the inner edges of each flag such that a portion of the inner edges of each flag bound the seam. The portion of the inner edges of each flag bounding the seam may then be joined via one of the techniques used to form the seam such that a substantially rectangular or cylindrical pole bore may be formed, which may be adapted to receive a flag pole, rod, or other device configured to reinforce the stiffness and structure of flag 100 and orient the flag in a vertical position for viewing. The inserted pole or other device may then be mounted to a receiving structure on a vessel, surface marker buoy, or other body configured to float on a body of water. As a non-limiting example, a pole bore 107 is shown, which may be configured to receive a pole or other device extending along a substantially vertical axis represented by dashed lines. The pole or other device may be inserted in a buoy 109, for example, which may be configured to float on a body of water such that flag 100 remains substantially upright and visible when deployed. It will be appreciated that additional pole bores (e.g., a total of 2) may be formed in flag 100.

As shown, first and second flags 102 and 104 may be substantially rectangular, and may further be substantially flexible, allowing the flags to oscillate and waver in the presence of winds. First and second flags 102 and 104 may comprise a suitable material, for example cotton, nylon, polyester, etc., or any combination thereof. First and second flags 102 and 104 may further display another image or pattern, which may be selected based on an activity, location, or desired message. In this example, second flag 104 displays a white stripe extending from its lower right corner from an outer edge 110 to an upper left corner at inner edge 108. The stripe may be positioned between two regions of solid color, illustrated in this example by light shading. The color may be selected for its visibility when deployed adjacent to water, for example. The use of a white stripe extending diagonally across a face 112 of second flag 104 and surrounded by solid regions of red, for example, may indicate the presence of a diver underneath the surface of water and signal to approaching vessels to maintain a separation distance and reduce their speed. First flag 102 displays in this example an analogous mirror-image of the pattern of second flag 104 about seam 106, though the first and second flags may display different images or patterns without departing from the scope of this disclosure.

In the example of FIG. 1A, first and second flags 102 and 104 each include three grommets or eyelets configured to receive separating members as described below in further detail. Second flag 104, for example, includes a corner eyelet 114 disposed in its upper right corner proximate outer edge 110, while first flag 102 includes a corner eyelet 116 disposed in its upper left corner proximate its outer edge. Eyelets 114 and 116 may be comprised of a suitable material, such as copper, steel, stainless steel, etc., which may be selected to reduce cost and/or weight of flag 100. The eyelets may be integrally formed with flag 100 or added following formation of the flag.

Eyelets 114 and 116 in this example accommodate the attachment of a transverse spreading or separation member 118. Separation member 118, in cooperation with other separation members described below, is configured to maintain an angular separation between first and second flags 102 and 104, providing a three-dimensional, panoramic, angularly separated, V-like shape to flag 100. As flag 100 is three-dimensional and panoramic, the flag may be observed and visible from each angle in a 360° range in a plane perpendicular to the faces (e.g., face 112) of first and second flags 102 and 104—e.g., in a plane parallel to the surface of a body of water such as an ocean. In particular, at least one of the faces of first and second flags 102 and 104 may be visible from sightlines extending along such a plane. Flag 100 may thus provide advantages over approaches in which a single, substantially two-dimensional flag is used to indicate the presence of a diver, as such a flag may be invisible or at least unidentifiable along certain sightlines (e.g., sightlines corresponding to an edge as opposed to face of the flag). Moreover, the apparent size and visibility of first and second flags 102 and 104 may be increased and broadened from sightlines which correspond substantially to anterior and posterior views of flag 100—e.g., from these perspectives, at least portions of both flags may be observed as opposed to a single flag.

It will be appreciated that the length and/or compression of separation member 118 may control the angular separation and angular opposition between first and second flags 102 and 104 by applying a separating force between the first and second flags. The angular separation may be substantially 45° (e.g., within +/−10°), for example, though a plurality of angular separations including oblique angles may be applied without departing from the scope of this disclosure. In some embodiments, separation member 118 may be utilized to display additional indicators, flags, or other markers—for example, a third flag may be attached via suitable means (e.g., hooks, ties, etc.) to the separation member.

FIG. 1B shows a top view of panoramic diver down flag 100, particularly illustrating how the flag may be viewed throughout an angular range. In this example, a viewpoint or sightline 130 of an observer 132 is shown intersecting a region of flag 100. Flag 100 rotates (e.g., clockwise or counterclockwise) during deployment about a vertical axis 134. A surface normal 136 is further shown, extending perpendicularly from face 112 of second flag 104 and forming an angle 138 with sightline 130. In this scenario, angle 138 may be 45°, for example, and may be the maximum angle between an observer and sightline at which second flag 104 is visible while first flag 102 remains indistinguishable. As flag 100 rotates in a counterclockwise direction about vertical axis 134, angle 138 may increase beyond 45°, decreasing visibility of second flag 104. However, as angle 138 increases, first flag 102 may become increasingly visible. As such, at least a portion of flag 100 may be visible at any rotational orientation of the flag about vertical axis 134. More particularly, at least one of two surface normals each extending perpendicularly from first and second flag 102 and 104, respectively, may remain at or below 45° relative to an observer sightline (e.g., sightline 130). For example, angle 138 may be no less than 60°, reducing visibility of second flag 104, while at least a face of first flag 102 is at least partially visible. At least a face of first or second flags 102 and 104 may be at least partially visible from each and every angle as angle 138 varies throughout a 360° range. As another example, at least a face of one of first and second flags 102 and 104 may be visible at no more than a 50° angle from each sightline extending alone a plane perpendicular to vertical axis 134, which may correspond to a body of water.

Turning now to FIG. 2, a posterior view of panoramic diver down flag 100 is shown, particularly illustrating the inclusion of additional eyelets and separating members. First and second flags 102 and 104 each include in this example an upper eyelet (e.g., upper eyelet 120) and a lower eyelet (e.g., first lower eyelet 122 and second lower eyelet 124). It will be appreciated that the eyelets described and shown herein are provided as non-limiting examples and that their position, number, formation, and attachment may be varied without departing from the scope of this disclosure. The eyelets (e.g., one or more of upper eyelet 120, lower eyelet 122, corner eyelet 114 and 116) may be integrally formed with first and second flags 102 and 104. Alternatively, the eyelets may be disposed in a portion of fabric which may be subsequently affixed to various locations on each of first and second flags 102 and 104. Moreover, while the upper and lower eyelets are shown in this example as being disposed on a posterior side of flag 100 (e.g., on an interior side), one or more of the upper and lower eyelets may instead be disposed on an anterior side of flag 100 (e.g., on an exterior side as shown in FIG. 1A). For example, the upper eyelets may instead be disposed on the exterior side of flag 100 while the lower eyelets may be disposed on the interior side.

Like corner eyelets 114 and 116, lower eyelets 122 and 124 are configured to accommodate separation members and may be comprised of various suitable materials (e.g., copper, steel, stainless steel, etc.) of various gauges. In particular, lower eyelet 122 of first flag 102 cooperates with corner eyelet 116 to receive a first angled separation member 126, while lower eyelet 124 of second flag 104 cooperates with corner eyelet 114 to receive a second angled separation member 128. Angled separation members 126 and 128 are configured to straighten and stiffen first and second flags 102 and 104, respectively, and provide a structure by which the faces (e.g., face 112 of second flag 104) of the first and second flags may be substantially flat such that the flags do not fold over and remain in an open position as shown in FIG. 2. The structural enhancement provided by the angled separation members may, for example, allow flag 100 to retain its shape in the presence of strong winds and other forces. In this embodiment, angled separation members 126 and 128 are attached on the interior side of flag 100, as shown in the posterior view of FIG. 2. Transverse separation member 118 is conversely attached on the exterior side of flag 100 (as seen in the anterior view of FIG. 1A). The angled separation members 126 and 128 may produce forces in partial opposition to forces produced by transverse separation member 118, which may maintain flag 100 in a deployed, panoramic, three-dimensional state in which first and second flags 102 and 104 are angularly opposed.

Referring now to FIG. 3, an example of a spreading or separation member 300 in accordance with the present disclosure is shown. Separation member 300 may be, for example, one or more of transverse separation member 118, angled separation member 126, and angled separation member 128. In this embodiment, separation member 300 includes at each end a grip 302. As separation member 300 is inserted into a pair of eyelets (e.g., corner eyelet 116 and first lower eyelet 122), the grips 302 are configured to catch and grip a portion of the eyelets to thereby secure and attach the separation member. As shown, the distal ends of the grips 302 may be formed as sharp, shallowly-angled clips into which eyelets may be received and securely held at inflection points (e.g., inflection point 304). Grips 302, in cooperation with the body of separation member 300, may produce a holding force opposite to each other when installed in a pair of eyelets, providing a secure attachment of the separation member to the eyelets. Moreover, grips 302 may facilitate fast, easy, and releasable installation/removal of separation member 300 to/from eyelets. It will be appreciated, however, that grips 302 are shown as a non-limiting example and that other suitable attachment mechanisms may be disposed on separation member 300 to facilitate its attachment and removal.

Separation member 300 may be comprised of various suitable materials. In some embodiments, separation member 300 is formed into a hard, stiff wire-like element, in which case the separation member may be comprised of an appropriate, suitable material (e.g., steel, spring steel, stainless steel, carbon fiber, fiber glass rods, etc.). In other embodiments, separation member 300 may be a flexible, compressible element, for example an elastic cord or rod (e.g., a bungee cord) such that their lengths may be adjusted. Regardless of the material used, the length of separation member 300 may be varied depending on the distance between the eyelets to which the separation member is attached, and also the flags which include such eyelets. The gauge (e.g., diameter) of separation member 300 may further be varied based on various desired characteristics of the separation member and the flag to which it is attached, such as the size of eyelets in the flag and weight of the flag.

Turning now to FIGS. 4A and 4B, scenarios are illustrated showing how a panoramic diver down flag in accordance with the present disclosure may be folded, rolled, and packed for convenient transport and storage. An exemplary flag 400 is shown for the sake of illustration, though it will be appreciated that flag 400 may be flag 100 shown in FIGS. 1A, 1B, and 2 in a state in which the separation members have been removed.

As flag 400 and constituent flags (e.g., first and second flags 102 and 104) may be comprised of a substantially flexible material, the flag may be folded as shown in FIG. 4A. Flag 400 may be folded, for example, in a partially transverse direction to bring a face (e.g., face 112 of second flag 104) of one constituent flag in contact with the face of the other constituent flag. Then, flag 400 may be rolled from a side bounding eyelets 402 along a direction 404, bringing the flag into a compact and rolled configuration. FIG. 4B shows flag 400 in a substantially compact, rolled configuration, which may undergo further rolling and compaction to bring the flag to a substantially packed, cylindrical state. In this state, flag 400 may be restrained by a suitable device (e.g., string, tie, rubber band, etc.) and optionally placed in a carrier (e.g., bag) for transport and/or storage.

It will be appreciated that various aspects of the panoramic diver down flags described above and shown with reference to FIGS. 1A, 1B, 2, and 4 may be varied without departing from the scope of this disclosure. For example, the panoramic diver down flags may be adapted to alternative geometries; panoramic diver down flags may be provided which are substantially rectangular, cubical, pyramidal, spherical, irregular, etc. As shown in FIG. 1A, for example, additional flags may be attached to flag 100 at one or more of a side connecting first and second flags 102 and 104, at a top side, and at a bottom side. Further, separation members and other devices (e.g., reflectors, lights, LEDs, etc.) may be integrally formed in flag 100 and particularly in the faces of first and second flags 102 and 104.

It will be appreciated that the configurations disclosed herein are exemplary in nature, and that these specific embodiments are not to be considered in a limiting sense, because numerous variations are possible. The subject matter of the present disclosure includes all novel and nonobvious combinations and subcombinations of the various configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal or different in scope to the original claims, also are regarded as included within the subject matter of the present disclosure.

The invention claimed is:

1. A panoramic flag, comprising:

a first flag and a second flag, each flag having a corner grommet at an outer edge, an upper grommet, and a lower grommet, the upper and lower grommets disposed at an inner edge;

a transverse spreading member attached to each corner grommet; and a first and a second angled spreading member, each angled spreading member attached at a first end to the corner grommet and attached at a second end to the lower grommet of the first and second flags, respectively;

wherein the first flag is attached to the second flag along the inner edge.

2. The panoramic flag of claim 1, further comprising a pole bore disposed along the inner edge, the pole bore configured to receive a flag pole.

3. The panoramic flag of claim 1, wherein the panoramic flag is configured to be rolled in a compact, substantially cylindrical shape.

4. The panoramic flag of claim 1, wherein the transverse spreading member is configured to maintain an angular separation between the first and the second flags.

5. The panoramic flag of claim 4, wherein the angular separation is substantially 45 degrees.

6. The panoramic flag of claim 1, wherein the angled spreading members are configured to straighten and maintain the first and the second flags in an open position.

7. The panoramic flag of claim 1, wherein at least a face of one of the first flag and the second flag is visible at no more than a 50 degree angle from each sightline extending along a plane about a vertical axis with respect to a body of water, the plane perpendicular to the face of one of the first flag and the second flag.

8. The panoramic flag of claim 1, wherein the transverse spreading member and the angled spreading members are comprised of one or more of steel, spring steel, stainless steel, carbon fiber, and fiber glass rods.

9. The panoramic flag of claim 1, wherein the transverse spreading member and the angled spreading members are flexible and compressible rods.

* * * * *